United States Patent [19]

Eaves

[11] 4,106,274

[45] Aug. 15, 1978

[54] YARN TEXTURING MACHINE

[75] Inventor: Ronald Spencer Eaves, Chapel-en-le-Frith, England

[73] Assignee: Ernest Scragg & Sons Limited, Macclesfield, England

[21] Appl. No.: 779,938

[22] Filed: Mar. 21, 1977

[30] Foreign Application Priority Data

Mar. 23, 1976 [GB] United Kingdom ..... 11595/76

[51] Int. Cl.[2] ..... D01H 13/28; D02G 1/02

[52] U.S. Cl. ..... 57/34 HS; 57/106

[58] Field of Search ..... 57/1 R, 34 R, 34 HS, 57/157 R, 157 TS, 106

[56] References Cited

U.S. PATENT DOCUMENTS

| | | | |
|---|---|---|---|
| 3,367,096 | 2/1968 | Comer et al. | 57/34 HS |
| 3,501,904 | 3/1970 | Batsch | 57/34 HS |
| 3,791,121 | 2/1974 | Ernst | 57/34 HS |
| 3,916,609 | 11/1975 | Yamada et al. | 57/34 HS |
| 3,942,312 | 3/1976 | Venot | 57/106 X |
| 3,946,546 | 3/1976 | Venot | 57/34 HS |
| 3,956,878 | 5/1976 | Schaffer et al. | 57/157 TS |
| 3,962,829 | 6/1976 | Schippers | 57/34 HS |
| 3,971,200 | 7/1976 | Richter | 57/34 HS |
| 3,999,360 | 12/1976 | Forin et al. | 57/157 TS X |

FOREIGN PATENT DOCUMENTS

| | | | |
|---|---|---|---|
| 2,219,257 | 9/1974 | France | 57/34 HS |

*Primary Examiner*—Donald Watkins
*Attorney, Agent, or Firm*—Michael J. Striker

[57] ABSTRACT

A yarn texturing machine has a texturing section spaced from a creel section by an operator's aisle. Setting heaters are located upright in proximity with the creel, and have their bottom inlet ends well above floor level and their top exit ends extending above the creel. Yarn cooling and stabilizing guides span the aisle and are downwardly inclined from the top ends of the setting heaters towards the texturing section.

3 Claims, 2 Drawing Figures

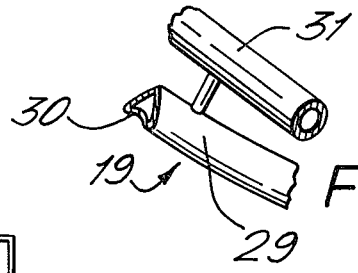
FIG.2.
FIG.1.
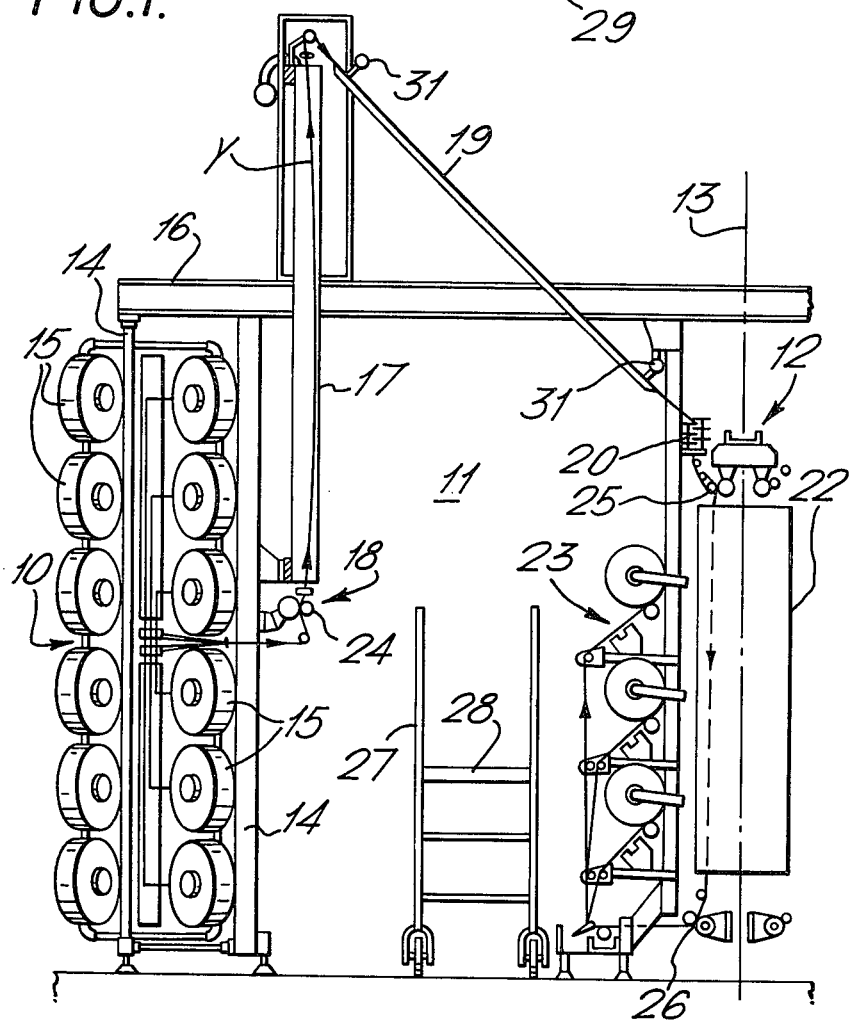

YARN TEXTURING MACHINE

This invention relates to a multi-station yarn texturing machine which textures yarn by false twist crimping, a process in which at each station an untextured yarn from a supply source runs over a setting heater and through a cooling zone followed by a false twister, twist being propogated upstream of the false twister and set by the heater. In the heating zone the yarn temperature is raised close up to its melting point, and in the cooling zone the yarn temperature is reduced until the yarn is sufficiently stable to withstand the action of the false twister.

In drawtexturing the feed yarn is either undrawn or partially drawn and drawing is completed on the texturing machine, either by a separate drawing step preceding false twist crimping (sequential) or by drawing at the same time as false twist crimping (simultaneous) and in so-called double-heater machines for producing set yarns, the yarn runs from the false twister through a secondary heater while under controlled overfeed conditions, so that the final product is crimped yarn of low extensibility in comparison with the so-called torque stretch yarn produced by a single heater machine.

All the foregoing is well known in the art, and it has also hitherto been proposed to positively cool the yarn in the cooling zone, rather than the yarn becoming cooler merely by its exposure to the ambient atmosphere, and prior art proposals in the patents literature have included enclosures, tubes, jackets, and contact blocks on pipes, the coolants suggested being air or circulated water and the like.

In known yarn texturing machines, the usual arrangement is to have packages of supply yarn on a so-called "stand-off" creel, on which the supply packages are carried in tiers and columns, the usual arrangement being that each thread-line is fed from an active supply package connected to a reserve package.

The creel may be a wholly fixed structure or it may be at least partially movable, for example it may comprise a fixed frame with which are associated movable sub-frames each carrying a predetermined number of supply packages.

These creels tend to be quite high since the supply packages are large, a typical stand-off creel carrying tiers of packages in columns six high being something over 2 meters in height, so that operatives need to use mobile platform stepladders to service both the creel and the yarn texturing machine fed by the creel.

Modern machines tend to be double-si ded and have a row of texturing stations along each side, e.g. 108 stations at each side which are supplied by respective stand-off creels with an operative's aisle between creel and machine.

In the constant search to increase production rates by increasing yarn throughout speeds, setting heaters and secondary heaters have become progressively longer, as well as cooling zones, until currently two meter, 2.5 meter, and three meter setting heaters are already in use along with secondary heaters of 1.45 to 2 meters in length.

In machines where the yarn runs downwardly in a vertical path, double-heater machines are approaching six meters in height, and as well as the obvious disadvantages which follow from such vast height, there are undesirable lengths of yarn running in uncontrolled manner from the creel to the top ends of the setting heaters.

The object of this invention is to provide a yarn texturing machine of reduced height and without the disadvantage of uncontrolled running yarn lengths.

According to the invention, in a yarn texturing machine operating with a stand-off creel, the setting heaters are disposed upright in proximity with the creel and the yarns run upwardly over the heaters which have their inlet ends a substantial distance above floor level, while from the top exit ends of the heaters, which extend above the creel, the yarns run over elongate stabilising and cooling guides which span an operator's aisle and are downwardly inclined towards a texturing section which mounts at least false twisters and package winders.

Preferably the setting heaters are disposed at that side of the creel which faces the texturing section across the operator's aisle.

Secondary heaters may be provided to treat yarns running between the false twisters and package winders.

FIG. 1 is a diagrammatic end view showing the left-hand half of a double-heater yarn texturing machine.

FIG. 2 is a fragmentary perspective view of a yarn stabilising and cooling guide included in FIG. 1.

Referring to FIG. 1 of the drawings, the yarn texturing machine comprises a stand-off creel section 10 spaced by an operator's aisle 11 from a texturing section 12. Only the left-hand half of the full machine is shown, since on the right of the longitudinal centre line 13 the right-hand half is a mirror image of the left hand half.

The machine is a multi-station machine, although in the end view only one threadline can be indicated.

A creel frame 14 carries yarn supply packages 15 in columns and tiers, in columns six high, the creel height being about 2.8 meters to cross-struts 16 which link it with the texturing section 12. The packages 15 need not be mounted on the fixed main frame, but instead could be on movable sub-frames (not shown) each carrying a predetermined number of packages.

The setting heaters 17, only one of which is shown in the drawing, are disposed upright in proximity with the creel and preferably (as shown) at that side of the creel 10 which faces the texturing section 12 across the aisle 11, the heaters being mounted on the creel frame 14. The inlet end 18 of the heater 17 is well above floor level and approximately midway of the creel height, and the heater shown is 2 meters in length and extends above the creel. From the top exit end of the heater the yarn Y runs over an elongate stabilising and cooling guide 19 which spans the aisle 11 and is steeply downwardly inclined towards the texturing section 12, the length of this guide being about 2.2 meters, depending upon the length of the heater 17 which could also be 2.5 or 3 meters or more in length without any need for drastic modification of the machine.

From the guide 19 the yarn enters a false twister 20 of the texturing section 12, the false twister preferably comprising stacks of overlapping friction discs, as described in our British patent specifications Nos. 1419085 and 1419086, and from the false twister 20 the yarn runs through a secondary heater 22 and then to a package winder section 23.

At the inlet end of the heater are the usual input feed rolls 24, and between the false twister 20 and the secondary heater are the usual intermediate feed rolls 25, the usual delivery rolls 26 being located between the secondary heater 22 and the package winder section 23. The secondary heater 22 could be omitted to provide a single heater machine.

It will be seen from the left side of FIG. 1 that six yarns from a column of six supply packages all leave the creel about midway of its height to reach the input feed rolls 24, three yarns running upwardly and three downwardly from the column of packages to the input rolls.

An operator's mobile step ladder is indicated at 27 in the aisle 11, and is included to illustrate the operator convenience of the machine layout. An operator standing on the platform 28 has both the input feed rolls 24 and the false twister 20 within easy reach.

Threadline stability is optimized, since there are no long lengths of yarn running through space in uncontrolled manner, and a further convenience of the layout is the ease with which setting heaters 17 of varying lengths can be used, and longer cooling and stabilising guides 19 to suit selected heater lengths, so that machines having differing performances as to processing speed can be supplied to customer's requirements without changing the basic machine layout.

Although the cooling and stabilising guides could be of any desired form, ranging from plates cooled by ambient air to guides kept cool by internally circulated fluid according to yarn throughput speeds, the drawings shown a guide in the form of a tube 29, shaped to have a lengthwise yarn guide groove 30, through which cooling water is circulated from top and bottom headers 31.

I claim:

1. In a yarn texturing machine, a combination comprising a creel section comprising at least one upright row of yarn supply packages, said row having an upper and a lower end; a texturing section comprising package winders and at least one false twister, said false twister being located not higher than said upper end and said texturing section being on the same level as and transversely spaced from said creel section and defining therewith an operator aisle; at least one upright setting heater mounted adjacent to said creel section and having an outlet upwardly spaced from said upper end and an inlet located substantially midway between said upper and lower ends so that yarn from the supply packages above said inlet runs down to the same and yarn from the supply packages below said inlet runs up to the same; and at least one elongated yarn stabilizing and cooling guide spanning said aisle and extending from the vicinity of said outlet downwardly to said false twister, whereby the overall height of said machine is less than the combined heights of said row and said heater and the yarn is positively guided over substantially the entire distance from said inlet to said false twister.

2. Yarn texturing machine according to claim 1, wherein the setting heater is disposed at that side of the section which faces the texturing section across the operator's aisle.

3. Yarn texturing machine according to claim 1 wherein at least one secondary heater is provided in the texturing section to treat yarn running between the false twister and package winders.

* * * * *